United States Patent [19]

Habrovansk et al.

[11] Patent Number: 5,072,528

[45] Date of Patent: Dec. 17, 1991

[54] LASTING INSOLE

[75] Inventors: Josef Habrovansk; Vincenc Boltnar; Jirí Rybka; Albín Korvas; Jindrich Svajda, all of Gottwaldov, Czechoslovakia

[73] Assignee: Obuvnicky Prumsyl Svit, Czechoslovakia

[21] Appl. No.: 496,434

[22] Filed: Mar. 19, 1990

[30] Foreign Application Priority Data

Mar. 17, 1989 [CS] Czechoslovakia ..... 1658-89
Mar. 17, 1989 [CS] Czechoslovakia ..... 1662-89

[51] Int. Cl.[5] ..... A43B 13/38

[52] U.S. Cl. ..... 36/43; 36/44; 36/17 R

[58] Field of Search ..... 36/43, 44, 17 R, 17 PW, 36/22 A; 12/146 BC, 146 B, 146 BP

[56] References Cited

U.S. PATENT DOCUMENTS

| | | | |
|---|---|---|---|
| 1,140,918 | 5/1915 | Rooney | 36/22 A |
| 1,236,661 | 8/1917 | Bertrand | 12/146 BC |
| 1,735,457 | 11/1929 | Gilson | 36/17 R |
| 1,924,542 | 8/1933 | DeLiso | 36/43 X |
| 2,049,159 | 7/1936 | Ellis | 12/146 BP |
| 2,068,706 | 1/1937 | Ray | 36/22 A |
| 2,103,331 | 12/1937 | Mathews | 36/17 R |
| 2,204,505 | 6/1940 | Lumbard | 36/22 A |
| 2,209,387 | 7/1940 | Cort | 36/43 X |
| 2,318,926 | 5/1943 | Daniels | 36/22 A |
| 2,342,719 | 2/1944 | Baker | 12/146 BP |
| 2,370,829 | 3/1945 | Wright | 12/146 BP |
| 2,389,114 | 11/1945 | Wright | 12/146 BP |
| 2,538,776 | 1/1951 | Griswold | 12/146 BP |
| 2,627,079 | 2/1953 | Ridderstrom | 12/146 BP |
| 2,658,287 | 11/1953 | Bazzoli | 36/17 PW |

FOREIGN PATENT DOCUMENTS

| | | | |
|---|---|---|---|
| 115741 | 1/1930 | Australia | 36/22 |
| 251741 | 12/1986 | Czechoslovakia . | |
| 254361 | 5/1987 | Czechoslovakia . | |
| 0238177 | 9/1987 | European Pat. Off. | 36/43 |
| 1078082 | 8/1967 | United Kingdom . | |
| 2086710 | 5/1982 | United Kingdom | 36/43 |
| 2131277 | 6/1984 | United Kingdom | 36/43 |

*Primary Examiner*—Paul T. Sewell
*Assistant Examiner*—BethAnne Cicconi
*Attorney, Agent, or Firm*—Ostrolenk, Faber, Gerb & Soffen

[57] ABSTRACT

A lasting insole for a welted shoe. The lasting insole includes: a support layer; a rib for connecting an upper and a welt to the support layer; and connecting structure for connecting the rib to the support layer. The connecting structure is located between the rib and the support layer. Stress encountered during use of the welted shoe is shifted away from the connecting structure. Preferably, the stress is shifted by spaced apart grooves. The grooves are formed by projections which are pressed into the support layer. The projections also facilitate the formation of the rib.

10 Claims, 2 Drawing Sheets

LASTING INSOLE

BACKGROUND OF THE INVENTION

The present invention relates to a lasting insole for a welted shoe, to a method of manufacturing a lasting insole and to an apparatus for manufacturing a lasting insole.

To manufacture a welted shoe, the margin of a lasted upper is stitched to a rib of a lasting insole, a welt is also stitched to the rib and then an outsole is fastened to the welt. A midsole may also be fastened to the welt. A welted shoe has several advantages, including good flexibility.

To manufacture a conventional or "Goodyear" lasting insole, a support layer is cut from leather, the support layer is slashed along its periphery, the slashed periphery is turned out at a 90° angle to form a rib and then a textile strip is tacked to the rib and to the support layer to reinforce the rib.

The conventional method of manufacturing a lasting insole is disadvantageous for at least two reasons. First, the method requires an undue amount of leather. This is because the leather support layer must be quite thick so that the rib (which is slashed from the support layer) can be adequately thick. Both of the slashed parts must be adequately thick to keep sufficient strength. Second, the method is unduly complicated.

In an improved method of manufacturing a lasting insole, a support layer is cut from leather (natural leather, artificial leather or another appropriate material), a rib is formed from elastomeric material (such as rubber, polyurethane or polyvinylchloride) and then the elastomeric rib is bonded to the support layer by an adhesive connecting film which is applied to the support layer. To achieve the needed bond strength, the connecting film is formed of a material which bonds both to the material of the support layer and the material of the rib. This method is less complicated than the conventional method. Further, the improved method does not require as much leather as is required by the conventional method.

However, creating the appropriate bond between the material of the support layer and the elastomeric rib is difficult. The elastomeric rib and the support layer tend to separate from each other during use. The bond between the rib and the support layer deteriorates because stresses encountered during use are maximized at the interface between the rib and the support layer, i.e., where the edges of the rib meet the surface of the support layer. That is, when wearing the welted shoes, the rib is very stressed and thus the bond between the rib and the support layer is simultaneously stressed. The critical place of the bond is in the interfacing lines between the margins of the rib and the surface of the support layer.

The improved lasting insole is manufactured within an injection molding apparatus. In operation, the support layer is split or ground to a nominal thickness and then placed within a die part of the apparatus. In particular, the support layer is placed within a cavity which has a depth which is less than the nominal depth of the support layer. A punch part is then pressed against the die part.

As the punch part is pressed against the die part, a shaping cavity defined within the punch part is supposed to be sealed against the support layer to form the rib. But the shaping cavity is often not properly sealed to the support layer because the thickness of the leather support layer varies with changes in humidity (natural and artificial leathers are hygroscopic materials) and/or the support layer is not ground to the proper nominal thickness. As a result, some of the injected material which is supposed to form the rib escapes out of the shaping cavity. The injection molding apparatus operates with accurately measured batches. Therefore, when some of the injected material escapes, the resulting rib is incomplete and unsatisfactory.

Sherbrook, British Patent Specification No. 1,078,082, discloses a lasting insole with a rib which is formed of several layers of flexible material. Sherbrook's insole is unduly complicated.

Habrovansky, Czechoslovakian Author's Certificate No. 251,741, discloses a lasting insole which is formed entirely from plastic material. This material does not have the permeability of natural or artificial leather, which is important for hygienic reasons. Habrovansky's insole is not sufficiently permeable, even though holes are formed through the insole in an attempt to increase permeability.

Sevela, Czechoslovakian Author's Certificate No. 254,361, discloses a lasting insole which, like the improved insole described above, includes a leather support layer and an injection molded rib. Sevela's rib has integrally formed rivets which are supposed to be anchored in holes through the support layer. But the rivets often do not extend through the holes as desired and, as in the improved lasting insole, stress encountered during use is maximized along the interface between the rib and the support layer. Thus, Sevela s insole is not sufficiently durable. Further, the manufacture of Sevela's insole is unduly complicated.

SUMMARY OF THE INVENTION

The present invention relates to a lasting insole for a welted shoe. The lasting insole includes: a support layer; a rib for connecting an upper and a welt to the support layer; and connecting means for connecting the rib to the support layer. The connecting means is located between the rib and the support layer. The support layer also includes stress shifting means for shifting stress encountered during use of the welted shoe away from the connecting means.

Preferably, the support layer is formed of permeable material (such as leather) and the rib is formed of an injection molded material.

Preferably, stress is shifted away from the connecting means by positioning the rib between anchorage grooves which are pressed into the surface of the support layer.

Preferably, the connecting means is an adhesive film. Preferably, the adhesive film reinforces the support layer in the vicinity of the grooves.

The present invention also relates to a method of manufacturing a lasting insole. The method includes: placing a support layer within a die part; forming grooves within a surface of the support layer by pressing projections into the support layer; molding a rib for connecting an upper and a welt to the support layer by injecting material into a cavity; and adhering the rib to the surface of the support layer.

The present invention also relates to an apparatus for manufacturing a lasting insole. The apparatus includes: a die part for receiving a support layer; and a punch part which includes projections for forming spaced apart grooves within a surface of the support layer. The punch part also includes means for forming a rib for connecting an upper and a welt to the support layer. The means for forming the rib includes (a) a cavity which is located between the projections and (b) means for injecting material into the cavity.

Other features and advantages of the present invention will become apparent from the following detailed description of preferred embodiments of the invention, with reference to the accompanying drawings.

DETAILED DESCRIPTION OF THE PREFERRED EMBODIMENTS

Figure 1:
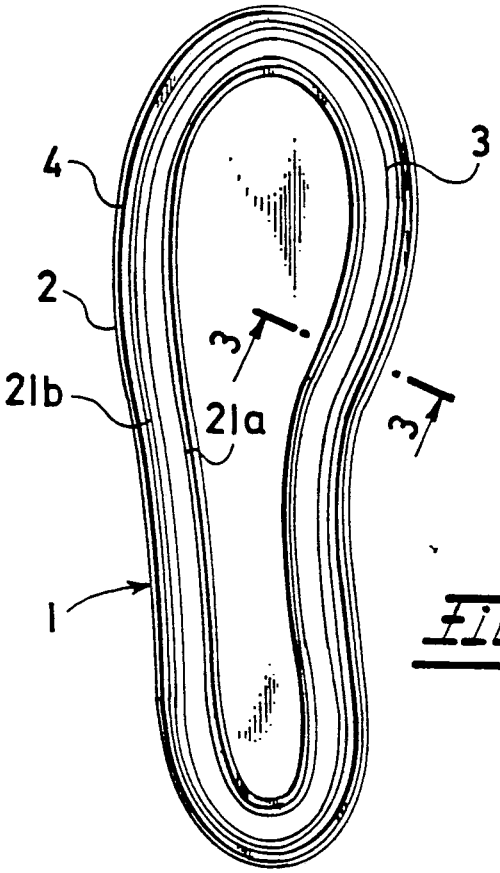
FIG. 1 is a plan view of a lasting insole.
Figure 2:
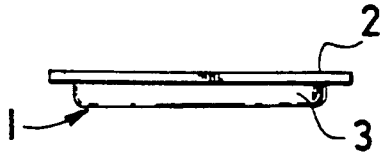
FIG. 2 is a side view of the insole of FIG. 1.

Referring now to the drawings, wherein like reference numerals indicate like elements, there is shown in FIG. 1 a lasting insole which is constructed in accordance with the principles of the present invention and designated generally as 1. The insole 1 includes a support layer 2 and a rib 3 which is to be connected to an upper and a welt (not illustrated). The rib 3 is fastened by pressing onto the support layer 2 and connected to the layer 2 by a film 4. Anchorage grooves 21*a*, 21*b* are located along both sides of the rib 3.

The support layer 2 is formed of permeable material, preferably natural leather. The rib 3 is formed of an injection molded material, preferably elastomeric polyvinylchloride. The connecting film 4 is preferably formed of a mixture of solvent adhesives which include polyurethane polymers and polyfunctional isocyanate.

Figure 3:
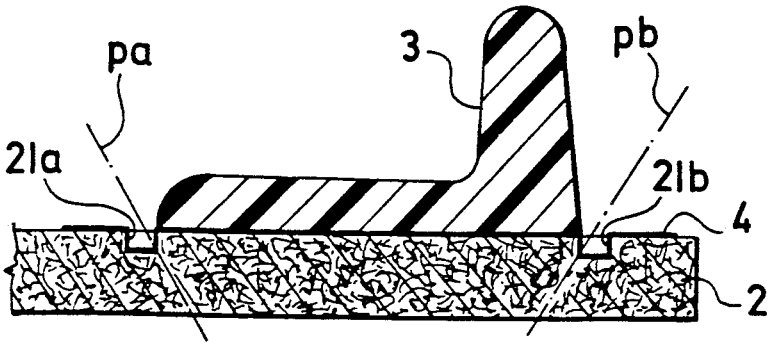
FIG. 3 is a cross sectional view through the line 3—3 of FIG. 1.

The rib 3 extends around the entire periphery of the support layer 2 and has a generally L-shaped cross sectional configuration as illustrated in FIG. 3. That is, the rib 3 includes a first elongated leg which extends generally perpendicularly away from the surface of the support layer 2 and a second elongated leg which is parallel to the support layer 2. The rib 3 has two laterally opposite edges 3*a*, 3*b*, the edge 3*a* being the bottom side of the first leg and the edge 3*b* being at the end of the second leg. The opposite edges 3*a*, 3*b* both extend generally perpendicularly away from the surface of the support layer 2. The edges 3*a*, 3*b* of the rib 3 meet the surface of the support layer 2 along actual interface lines.

Each of the grooves 21*a*, 21*b* includes an inner wall, a bottom surface and an outer wall. The inner walls of the grooves 21*a*, 21*b* are essentially coplanar with the opposite edges 3*a*, 3*b* of the rib 3 thus meet the edges 3*a*, 3*b* along the actual interface lines. Thus, the portion of the support layer 2 which is located between the grooves 21*a*, 21*b* effectively forms a smooth continuation of the rib 3.

Since the rib 3 is adhered to the support layer 2 between the inner walls of the grooves 21*a*, 21*b*, the effective continuation of the rib 3 creates effective interface lines between the rib 3 and the support layer 2 at the bottom surfaces of the grooves 21*a*, 21*b*, in particular, at the intersection of the bottom surfaces and inner walls of the grooves 21*a*, 21*b*.

If the anchorage grooves 21*a*, 21*b* were not present, maximum stress during use (particularly when the insole 1 is bent) would pass through the actual interface lines, i.e., the lines along which the edges 3*a*, 3*b* of the rib 3 meet the surface of the support layer 2. But the grooves 21*a*, 21*b* have the effect of shifting stress encountered during use of the welted shoe away from the actual interface lines and toward the effective interface lines. In other words, the grooves 21*a*, 21*b* have the effect of shifting stress encountered during use such that the maximum stress is directed through the lines pa, pb. This prevents deterioration of the bond between the rib 3 and the support layer 2 and thereby prolongs the useful life of a welted shoe made from the insole 1.

The adhesive film 4 extends through the grooves 21*a*, 21*b*, preferably marginally beyond the grooves 21*a*, 21*b*. This reinforces the support layer 2 in the vicinity of the grooves 21*a*, 21*b*. In other words, the connecting film 4 helps to properly connect the rib 3 to the support layer 2 and, moreover, secures reinforcing of the support layer 2 just in positions of maximum stress, i.e., the positions of the shape or effective interface lines.

Figure 5:
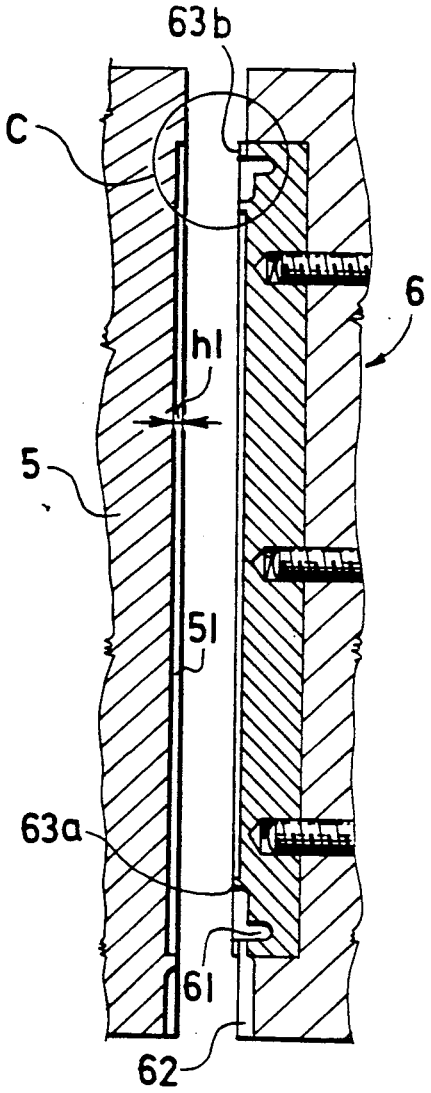
FIG. 5 is a cross sectional view through the line 5—5 of FIG. 4, with a punch part separated from a die part.
Figure 6:
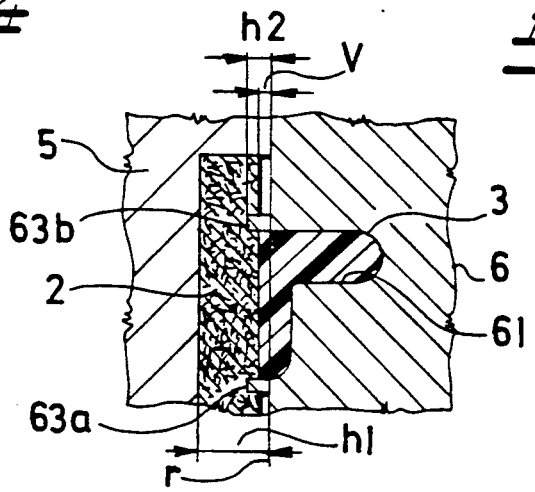
FIG. 6 is a detail of the apparatus of FIG. 4 in the area indicated by reference character C in FIG. 5, with the punch part pressed against the die part.

An apparatus or form for manufacturing the lasting insole 1 includes a die part 5 (FIG. 4) and a punch part 6. The die part 5 includes a cavity 51 (FIG. 5) with a depth h1 (FIG. 6) for receiving the support layer 2. The shape and size of the cavity 51 correspond to the shape and size of the support layer 2.

Figure 4:
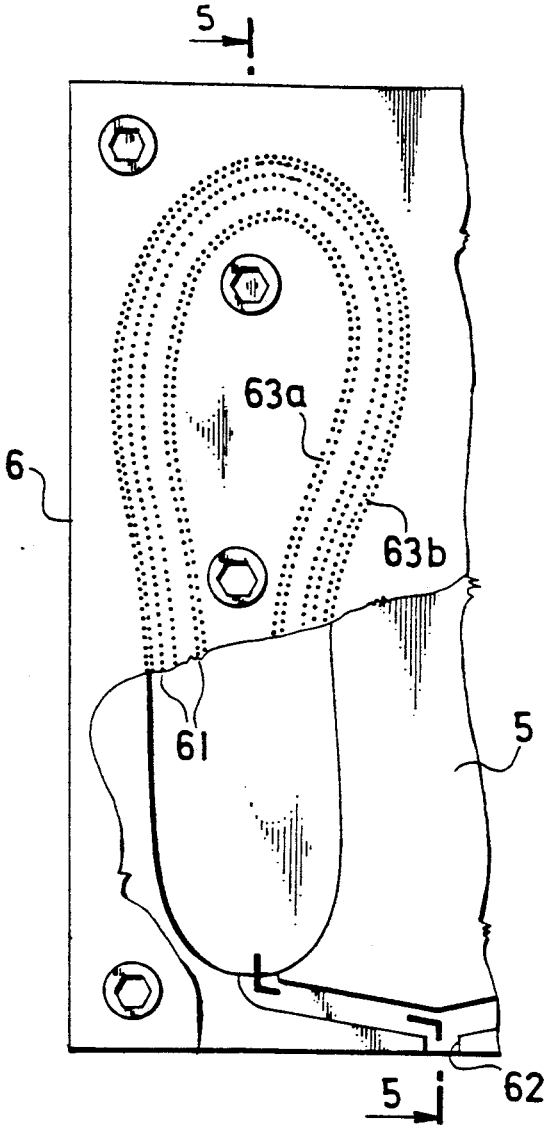
FIG. 4 is a partial cut away top view of an apparatus for manufacturing the insole of FIG. 1.

The punch part 6 has an L-shaped shaping cavity 61 for forming the rib 3. The cavity 61 is connected to an injection molding apparatus (not illustrated) by a supply hole 62 (FIG. 4).

Projections 63*a*, 63*b* for forming the grooves 21*a*, 21*b* are located along both sides of the shaping cavity 61. The projections 63*a*, 63*b* have a height h2 which is a function of the thickness of the support layer 2 and the depth h1. The height h2 is always greater than the clearance V between the nominal surface of the layer 2 and the punch part 6. Thus, when the parts 5, 6 are closed against each other (to form a common plane r), the projections 63*a*, 63*b* press into the layer 2. Thus, the projections 63*a*, 63*b* are pressed into the material of the support layer 2 and only then do the parts 5 and 6 bear against themselves in the dividing plane r. This way, the circumferential projections 63*a*, 63*b* always safely seal the shaping cavity 61.

To manufacture the lasting insole 1, the support layer 2 is cut from natural leather and then placed into the cavity 51. The punch part 6 is then pressed toward the die part 5. This causes the projections 63*a*, 63*b* to bear against the support layer 2. As the punch part 6 is pressed toward the plane r, the projections 63*a*, 63*b* are pressed into the layer 2 to form the grooves 21*a*, 21*b*.

Plastic material is injected into the shaping cavity 61 to form the rib 3. Since the projections 63*a*, 63*b* are longer than the clearance V, the plastic material never escapes out of the shaping cavity 61, even if the nominal thickness of the support layer 2 varies with changes in humidity, and even if the support layer 2 is not split or ground to the proper nominal thickness. The formation of the rib 3, the formation of the grooves 21*a*, 21*b* and the adhering of the rib 3 to the layer 2 all occur essentially simultaneously.

Although the present invention has been described in relation to a particular embodiment thereof, many variations and modifications and other uses will become apparent to those skilled in the art. It is preferred, therefore, that the present invention be limited not by the specific disclosure herein, but only by the appended claims.

What is claimed is:

1. A lasting insole for a welted shoe, said lasting insole comprising:

a permeable support layer which includes a surface, said surface having spaced apart grooves extending around its periphery;

a rib for connecting an upper and a welt to said support layer, said rib being located between said grooves and extending around the periphery of the surface of the support layer; and connecting means for connecting said rib to said surface of said support layer.

2. The insole of claim 1, wherein said rib has two lateral edges, said lateral edges being generally perpendicular to said surface of said support layer.

3. The insole of claim 2, wherein said grooves have inner walls, said inner walls of said grooves being essentially coplanar with said lateral edges of said rib.

4. The insole of claim 3, wherein said rib is generally L-shaped with (a) a first leg for connecting the upper and the welt to said rib, said first leg extending generally perpendicularly away from said surface of said support layer and (b) a second leg for connecting said rib to said support layer, said second leg being parallel to said support layer.

5. The insole of claim 1, wherein said rib is formed of elastomeric material.

6. The insole of claim 1, wherein said rib is formed of injection molded material.

7. The insole of claim 1, wherein said connecting means comprises a film of adhesive.

8. The insole of claim 7, wherein said film of adhesive extends (a) across the entire width of said rib to connect said rib to said surface of said support layer and (b) through said grooves to reinforce said support layer in the vicinity of said grooves.

9. The insole of claim 8, wherein said film of adhesive extends marginally beyond said grooves.

10. The insole of claim 1, wherein said support layer comprises leather.

* * * * *